US007029085B2

(12) United States Patent
Yokouchi

(10) Patent No.: US 7,029,085 B2
(45) Date of Patent: Apr. 18, 2006

(54) INK JET HEAD AND INK JET PRINTER

(75) Inventor: Tsutomu Yokouchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/255,086

(22) Filed: Sep. 26, 2002

(65) Prior Publication Data

US 2003/0085973 A1 May 8, 2003

(30) Foreign Application Priority Data

Sep. 27, 2001 (JP) ..... 2001-296362

(51) Int. Cl.
*B41J 29/38* (2006.01)
*B41J 2/165* (2006.01)

(52) U.S. Cl. ..... 347/11; 347/27; 347/48

(58) Field of Classification Search ..... 347/11, 347/48, 27, 60, 85, 101, 9, 10, 5, 26, 20, 347/40, 44

See application file for complete search history.

(56) References Cited

U.S. PATENT DOCUMENTS 4,275,290 A * 6/1981 Cielo et al. ..... 347/61
4,296,309 A * 10/1981 Shinmi et al. ..... 347/204
5,023,625 A * 6/1991 Bares et al. ..... 347/48
5,479,196 A * 12/1995 Inada ..... 347/92
5,726,693 A * 3/1998 Sharma et al. ..... 347/48
5,754,194 A * 5/1998 Endo et al. ..... 347/15
5,790,152 A * 8/1998 Harrington ..... 347/48
6,042,219 A * 3/2000 Higashino et al. ..... 347/47
6,270,180 B1 * 8/2001 Arakawa et al. ..... 347/14
6,533,395 B1 * 3/2003 Dante et al. ..... 347/48
2002/0113848 A1 * 8/2002 Anagnostopoulos et al. .. 347/73

FOREIGN PATENT DOCUMENTS

JP 59085765 A * 5/1984
JP 62238755 A * 10/1987
JP 2001-71538 3/2001

* cited by examiner

*Primary Examiner*—Manish Shah
*Assistant Examiner*—Leonard Liang
(74) *Attorney, Agent, or Firm*—Whitham, Curtis, Christofferson & Cook, P.C.

(57) ABSTRACT

There is provided an ink jet head including a first drive element which is provided in correspondence with each ink jet nozzle and which has a thin film resistor for ejecting ink droplets from each ink jet nozzle and a thin film conductive electrode for feeding electricity to the thin film resistor, a second drive element which is formed in a vicinity of the first drive element and which vibrates ink in each ink jet nozzle corresponding to the first drive element for changing a meniscus position and a drive signal control device which controls at least one of a drive signal given to the first drive element and a drive signal given to the second drive element so that the ink droplets can be ejected at a desired meniscus position of the ink in each ink jet nozzle. There is also provided an ink jet printer using the ink jet head. The size of ink droplets can be made uniform, whereby a high-quality image can be recorded. The burden in the semiconductor process of a thermal ink jet head can be reduced which enables improvement of the production yield.

15 Claims, 8 Drawing Sheets

INK JET HEAD AND INK JET PRINTER

BACKGROUND OF THE INVENTION

1. Field of the Invention

The present invention relates to an ink jet head and an ink jet printer in which part of ink is boiled to generate bubbles to thereby eject an ink droplet from an ink jet nozzle, i.e., a thermal ink jet head and a thermal ink jet printer.

2. Description of the Related Art

In the case where an ink jet head of a thermal ink jet printer is of, for example, a top shooter type for ejecting an ink droplet substantially in a perpendicular direction to a head substrate, the ink jet head has a thin film resistor formed on a semiconductor substrate such as a silicon substrate that is a head substrate, an ink jet nozzle provided substantially above this thin film resistor, and an ink flow passage which is formed by a partitioning wall layer on the semiconductor substrate and which is in communication with this ink jet nozzle. A portion of the ink within the ink flow passage is rapidly boiled to generate bubbles to thereby eject the ink droplet from the ink jet nozzle.

In such an ink jet head, since ink is ejected by being pushed out of the ink jet nozzle by the expansion force of bubbles generated by heating the ink, the size of the ink droplet to be ejected (the amount of the ink to be ejected) depends upon the diameter of the ink jet nozzle formed or the amount of the ink within the ink jet nozzle immediately before the ink droplet is ejected, i.e., the meniscus position of the ink or the like, and the size of the ink droplet to be ejected (the amount of the ink to be ejected) from the ink jet nozzle is likely to fluctuate.

For this reason, it is desired to control the size of the ink droplet for every ink jet nozzle. However, since the ejection of the ink droplets depends upon the expansion force of the bubbles generated by boiling ink, it is difficult to control the size.

On the other hand, unlike the above-described thermal ink jet head, in the case of a so-called piezoelectric type ink jet head in which an electromechanical converter element for increasing or decreasing the volume of an ink pressure chamber by application of a drive signal is used instead of the above-described thin film resistor for ejecting the ink droplet from the ink jet nozzle, the meniscus position of ink within the ink jet nozzle is vibrated in advance by means of the electromechanical converter element so that the ink droplet is ejected in response to the timing of the meniscus vibration whereby the size of the ink droplet can be adjusted. For example, JP 2001-71538 A describes that, in the piezoelectric type ink jet head, a second voltage pulse (drive signal) can be applied in a desired meniscus position in the meniscus vibration excited by a first voltage pulse (drive signal) to eject an ink droplet to thereby adjust the size of the ink droplet.

By the way, since a thermal ink jet head in which a thin film resistor or a thin film conductive electrode is formed on a substrate by using a semiconductor manufacturing technique, in particular, a top shooter type thermal ink jet head for ejecting an ink droplet substantially in a perpendicular direction to the substrate surface, a thermal ink jet head has an advantage that the ink jet nozzles may be made on a large scale and with a high density in comparison with the piezoelectric type and, consequently, it is expected that a high-definition and high-quality image that is difficult to realize in the piezoelectric type is outputted by using the thermal ink jet head. In particular, however in order to prevent fluctuation for each ink jet nozzle, it is necessary that the size of the ink droplet to be ejected from each ink jet nozzle that has become smaller in size in order to accommodate the increase in the density of the ink jet nozzles be made uniform in order to achieve a high quality image.

However, in the thermal ink jet, since there is a problem such that the drive signal for ink ejection could not be given after the elimination of the generated bubbles, it has been impossible to desirably drive the first voltage pulse (drive signal) and the second voltage pulse (drive signal) close to each other as in the piezoelectric type but it is necessary to eject the ink in accordance with the attenuated meniscus vibration. Consequently, it is difficult to eject the ink droplet having the desired size.

Accordingly, with the thermal ink jet, it is difficult to eject the ink droplet whose size has been adjusted by controlling, as desired, the meniscus position that fluctuates in accordance with the meniscus vibration in the same manner as in the piezoelectric type. The current situation is that, in the thermal ink jet, it is difficult to output an image having the same quality as that of the image that may be realized by adjusting the size of the ink droplet in the piezoelectric system.

SUMMARY OF THE INVENTION

Accordingly, in order to overcome the above-noted defects, an object of the present invention is therefore to provide an ink jet head that can adjust the size of an ink droplet to be ejected as desired in a so-called thermal ink jet head capable of performing image recording with high quality on a large scale and with high integration.

Another object of the present invention is to provide an ink jet printer in which the ink jet head described above is used.

In order to attain the object described above, the first aspect of the present invention provides an ink jet head for ejecting ink droplets from ink jet nozzles to a recording medium, comprising; a first drive element which is provided in correspondence with each of the ink jet nozzles and which has a thin film resistor for ejecting the ink droplets from each of the ink jet nozzles by expansion of bubbles generated by boiling part of the ink and a thin film conductive electrode for feeding electricity to the thin film resistor, the thin film resistor and the thin film conductive electrode being formed on a substrate; a second drive element which is formed in the vicinity of the first drive element and which vibrates the ink in each of the ink jet nozzles corresponding to the first drive element for changing meniscus position; and a drive signal control means which controls at least one of a drive signal given to the first drive element and a drive signal given to the second drive element so that the ink droplets can be ejected at a desired meniscus position of the ink in each of the ink jet nozzles.

Preferably, the drive signal control means controls at least one of a timing between the drive signal given to the first drive element and the drive signal given to the second drive element, and a strength and a duration that each of the drive signals has.

Preferably, each of the ink jet nozzles is formed in a position facing the thin film resistor of a plate provided as an upper layer of a partitioning wall layer formed on a surface of the substrate, and the ink droplets are ejected from each of the ink jet nozzles substantially in a vertical direction to the surface of the substrate in the ink jet head.

Preferably, an ink flow path which communicates with each of the ink jet nozzles is formed on the surface of the substrate by the partitioning wall layer, and the ink flow path has a flow path height of 15 μm or less and each of the ink jet nozzles has a nozzle length of 35 μm or less.

Preferably, the second drive element has a thin film resistor for changing the meniscus position in each of the ink jet nozzles by vibration with bubbles generated by heating part of the ink and a thin film conductive electrode for feeding the electricity to the thin film resistor.

Preferably, at least the second drive element further includes a protective film for protecting the thin film resistor of the second drive element or an auto-oxidized coating formed by auto-oxidizing a surface of the thin film resistor of the second drive element on a top surface of the thin film resistor of the second drive element that comes in contact with the ink.

Preferably, the first drive element further includes a protective film for protecting the thin film resistor of the first drive element or an auto-oxidized coating formed by auto-oxidizing a surface of the thin film resistor of the first drive element on a top surface of the thin film resistor of the first drive element that comes in contact with the ink.

Preferably, a lateral width of the thin film resistor of the second drive element in a direction perpendicular to a direction in which the second drive element gets closer to the first drive element is increased or decreased stepwise or continuously as the second drive element gets closer to the first drive element.

Preferably, the ink jet head has a plurality of ink jet nozzles, a plurality of first drive elements and a plurality of second drive elements, the first drive elements have a one-to-one correspondence with the ink jet nozzles and the second drive elements are formed in a one-to-one correspondence with the first drive elements.

Preferably, the first and second drive elements are arranged in one row in one direction, respectively.

Preferably, the ink jet head has at least a plurality of ink jet nozzles and a plurality of first drive elements, and the first drive elements have a one-to-one correspondence with the ink jet nozzles, respectively, and one second drive element is formed with respect to at least two or more of the first drive elements.

Preferably, the second drive element is formed on the substrate on which the first drive element is formed.

Preferably, the second drive element is the first drive element that is provided in correspondence with another ink jet nozzle.

Preferably, an inner surface of each of the ink jet nozzles has hydrophilic property which changes stepwise or continuously to water-repellent property toward an opening end of each of the ink jet nozzles.

The second aspect of the present invention provides an ink jet printer comprising an ink jet head for ejecting ink droplets from ink jet nozzles to a recording medium, comprising: a first drive element which is provided in correspondence with each of the ink jet nozzles and which has a thin film resistor for ejecting the ink droplets from each of the ink jet nozzles by expansion of bubbles generated by boiling part of the ink and a thin film conductive electrode for feeding electricity to the thin film resistor, the thin film resistor and the thin film conductive electrode being formed on a substrate; a second drive element which is formed in a vicinity of the first drive element and which vibrates the ink in each of the ink jet nozzles corresponding to the first drive element for changing a meniscus position; and a drive signal control means which controls at least one of a drive signal given to the first drive element and a drive signal given to the second drive element so that the ink droplets can be ejected at a desired meniscus position of the ink in each of the ink jet nozzles.

In other words, the second aspect of the present invention provides an ink jet printer using the above-described various ink jet heads of the first aspect of the present invention.

BRIEF DESCRIPTION OF THE DRAWINGS

In the accompanying drawings.

DESCRIPTION OF THE PREFERRED EMBODIMENT

The ink jet head and ink jet printer according to the present invention are now described below in detail with reference to the preferred embodiments shown in the accompanying drawings.

Figure 1A:
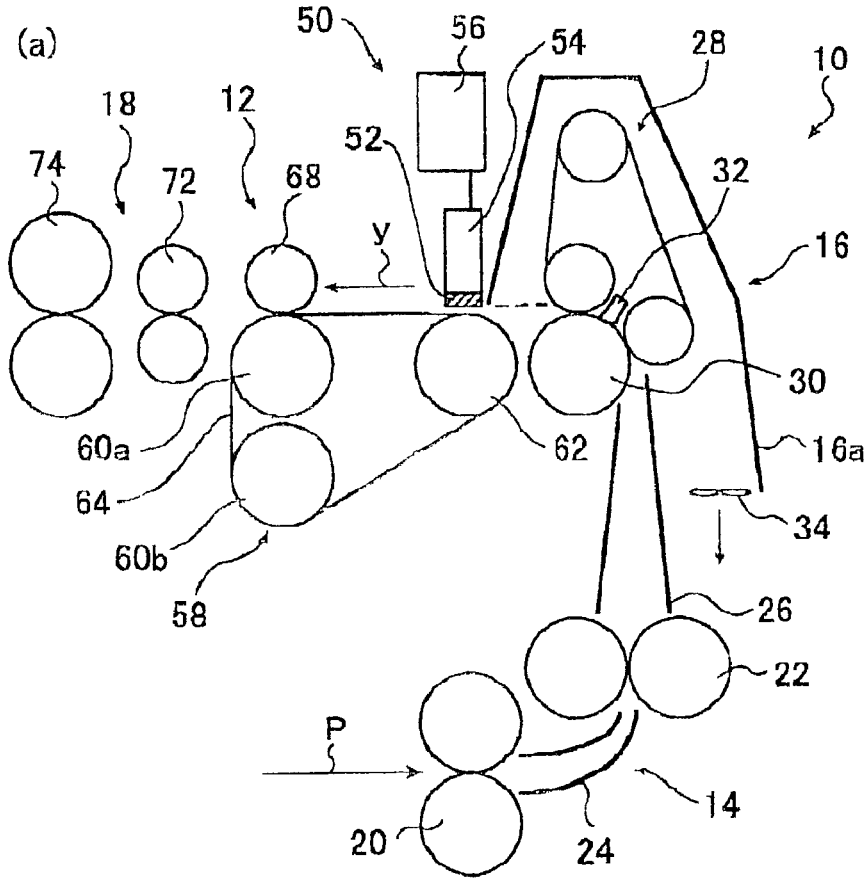
FIG. 1A is a view illustrating a schematic structure of an embodiment of the ink jet printer according to the present invention.
Figure 1B:
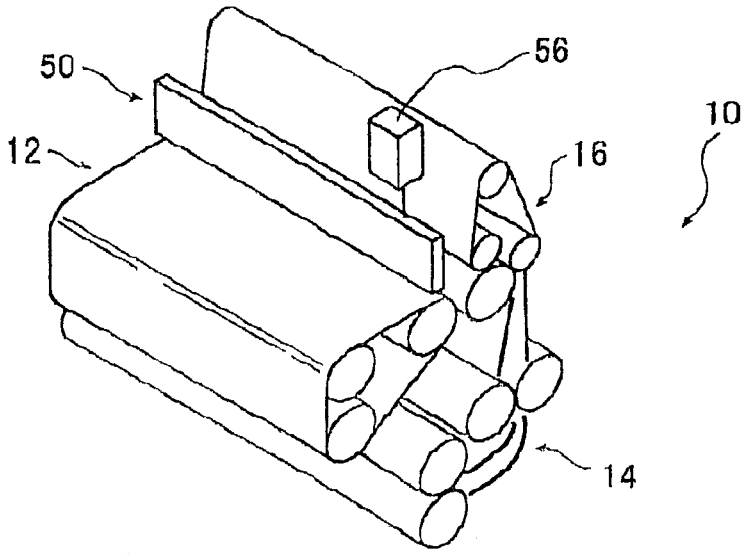
FIG. 1B is a perspective view of the ink jet printer shown in FIG. 1A.

FIGS. 1A and 1B show a printer 10 that is one embodiment of an ink jet printer on which an ink jet head according to one embodiment of the present invention is mounted.

FIG. 1A is a schematic structural view of the printer 10 and FIG. 1B is a schematic perspective view of the printer 10.

The printer 10 is an ink jet printer in which an ink jet head 52 is composed of a line head having a plurality of ink jet nozzles that are arranged on a large scale and with a high density in one direction for ejecting ink, over a length exceeding at least one side length of a recording medium P such as recording paper. The printer 10 has a recording section 12, a feeder section 14, a preheat section 16 and a discharge section 18.

The feeder section 14 has two pairs of conveyor rollers 20 and 22 and guides 24 and 26. The recording medium P is transferred from a lateral direction upwardly and fed to the preheat section 16 by means of the feeder section 14.

The preheat section 16 has a conveyor 28 composed of three rollers and an endless belt, a pressure roller 30 pressed from the outside of the conveyor 28 against the endless belt, a heating device 32 pressed against the pressure roller 30 from the inside of the conveyor 28 and an exhaust fan 34 for evacuating the interior of the preheat section 16.

Such a preheat section 16 heats the recording medium P prior to the ink jet recording to accelerate the drying of the ink ejected onto the recording medium P and to realize the high speed recording. The recording medium P fed from the feeder section 14 is heated from the recording surface side by the heating device 32, and is transferred to the recording section 12 while being clamped and transferred by the conveyor 28 and the pressure roller 30.

The recording section 12 has a recording head portion 50 and a recording medium conveyor portion 58. The recording head portion 50 has an ink jet head 52 having a head chip composed of an Si substrate, a recording control part 54 and an ink cartridge 56. The ink jet head 52 is connected to the recording control part 54.

The ink jet head 52 is a line head on a large scale in which a plurality of ink jet nozzles for ejecting ink droplets are arranged over a length exceeding at least one side length of the recording medium P having a maximum width to be used for image recording with the printer 10. The ink jet nozzles are arranged in the direction perpendicular to the paper surface in FIG. 1A. For example, the ink jet nozzles have a density of 1600 npi (nozzle/inch) or more.

Accordingly, the recording head portion 50 records the image at one time over the full recording width without scanning in the perpendicular direction to the paper surface in FIG. 1A on the recording medium P being transferred by the recording medium conveyor portion 58 having a belt 64 wound around conveyor rollers 60*a* and 60*b* and a drive roller 62.

The recorded medium P on which recording has been made is discharged from the discharge section 18 having two pairs of rollers 72 and 74.

Note that, the ink jet head 52 of the printer 10 is not limited to the line head but may be a serial type ink jet head in which the ink jet head 52 scans in a direction perpendicular to the feeding direction of the recording medium P.

Figure 2:
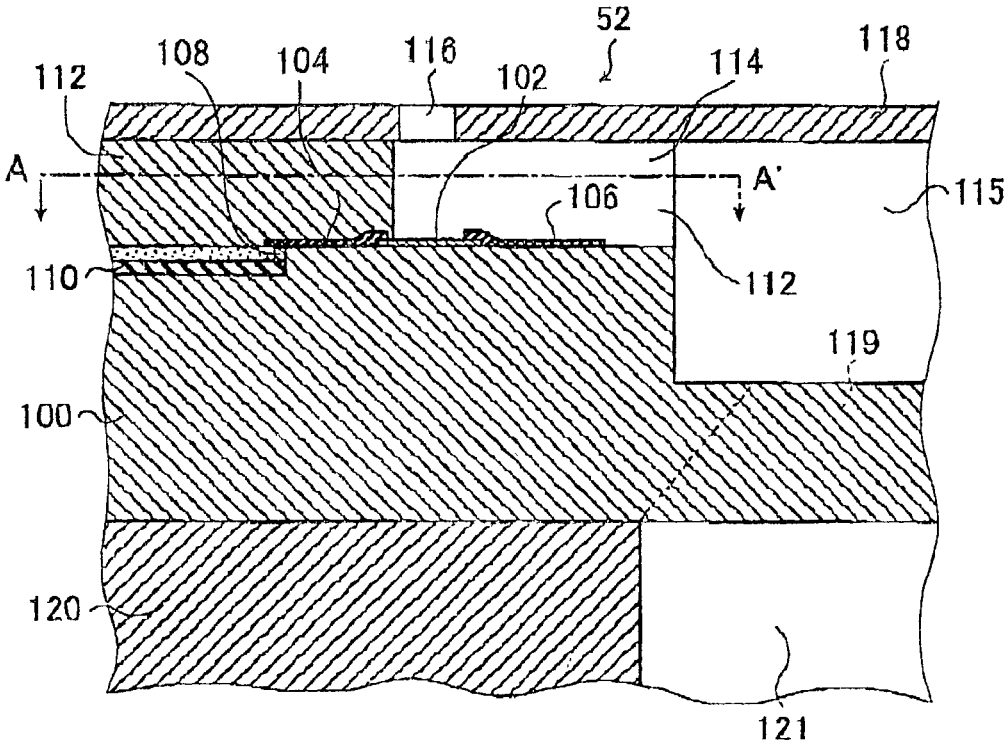
FIG. 2 is a schematic cross-sectional view showing an embodiment of the ink jet head according to the present invention.

The cross-sectional structure of the head corresponding to one ink jet nozzle in the ink jet head 52 of the printer 10 is shown in FIG. 2.

Namely, it has a thin film resistor 102 provided on a Si substrate 100 by sputtering, a thin film conductive electrode 104 and a common electrode 106 made of a thin film conductor for feeding electricity to the thin film resistor 102, and a drive portion 110 which has a function for controlling the drive signal and is connected through a via hole 108 to the thin film conductive electrode 104. Incidentally, a first drive element for ejecting the ink droplet according to the present invention is formed by the thin film resistor 102, the thin film conductive electrode 104 and the common electrode 106. Namely, the thin film resistor 102 corresponds to a thin film resistor according to the present invention by boiling part of the ink to generate bubbles and ejecting, by means of the expansion of the bubbles, the ink droplet substantially in the perpendicular direction (80 to 100 degrees) to the surface of the Si substrate 100 from an ink jet nozzle 116. Also, the thin film conductive electrode 104 and the common electrode 106 correspond to thin film conductive electrodes according to the present invention for feeding electricity to the thin film resistor 102.

In this case, the thin film resistor 102 is not particularly limited if any known thin film thermal resistor is used, but the resistor 102 is preferably made of Ta—Si—O three-element alloy. In the case of the thin film resistor 102 made of Ta—Si—O three-element alloy, an auto-oxidized coating (not shown) that in excellent in electric insulation and also anti-cavitation property is formed on its surface. Since the auto-oxidized coating requires a very small thickness of 0.01 μm, the auto-oxidized coating is advantageous in the increase of the responsibility of bubble generation to the voltage applied and the decrease of the magnitude of the voltage applied.

Instead of the auto-oxidized coating, a protective layer having a thickness of 1 μm or less may also be formed on the surface that is to be brought into contact with the ink.

Also, a partitioning wall layer 112 formed of resin material such as polyimide is provided so as to cover a part of the thin film resistor 102, the thin film conductive electrode 104, the via hole 108 and a substantially entire area of the drive portion 110. On this partitioning wall layer 112, partitioning walls 112*a* and 112*b* (see FIG. 3) are arranged to define an individual ink path 114 (ink flow path) corresponding one to one to the thin film resistor 102 (in the perpendicular direction to the paper surface of FIG. 2) arranged in one direction. The individual ink path 114 is formed so as to be connected to an ink feed path 121 connected to the ink cartridge 56 provided in a mounting frame 120 through an ink feed hole 119 formed intermittently in the Si substrate 100 and a common ink path 115.

In this case, when the ink droplet is ejected by the generation of bubbles, the individual ink path 114 is set to have a height of the flow path corresponding to the maximum growth of the bubbles to separate the ink to be ejected as the ink droplet from the ink to be left by the expansion of the bubbles thereby ejecting the ink to be ejected as the ink droplet and to prevent the ink from being splashed. The flow path height of the individual ink path 114 is specifically set to be at 15 μm or less.

The ink jet nozzle 116 is a nozzle for ejecting the ink droplet to the surface of the plate (hereinafter also referred to as orifice plate) 118 substantially vertically and formed in the plate 118 attached to an upper surface of the partitioning wall layer 112 forming a part of the wall surface of the individual ink passage 114 substantially vertically above the thin film resistor 102 in FIG. 2. The ink jet nozzle 116 may be a nozzle for ejecting the ink droplet at a constant slant angle to the plate 118. In this case, the plate 118 is used to separate the ink to be ejected as the ink droplet from the ink to be left and to eject the ink to be discharged as the ink droplet so that the ink splash is not generated when the ink is ejected, more specifically, the thickness of the plate 118, i.e., the length of the ink jet nozzle 116 is set at 35 μm or less. Since the maximum growth height of the generated bubbles is approximately in the range of 20 to 40 μm, it is possible to eject all the ink within the ink jet nozzle 116 based on the setting of the length of the ink jet nozzle 116 and the flow path height of the individual ink path 114.

Figure 3:
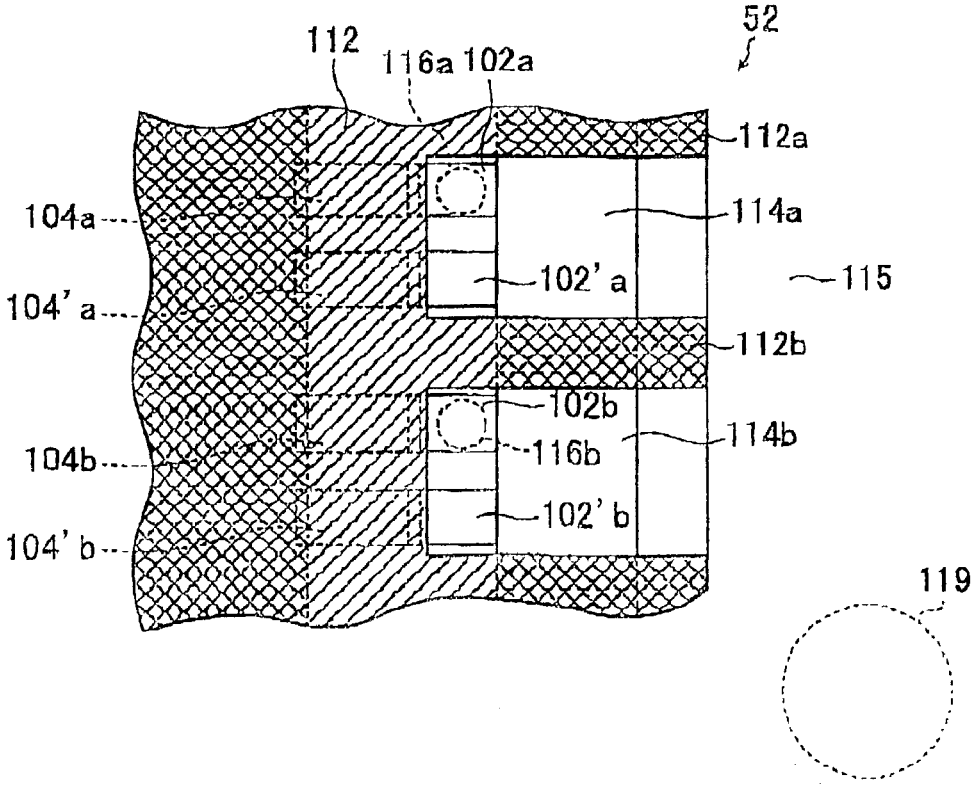
FIG. 3 is a cross-sectional view of the ink jet head taken along the line A–A' of FIG. 2.

FIG. 3 is a cross-sectional view of the ink jet head 52 taken along the line A–A' of FIG. 2. In FIG. 3, characters such as "a" and "b" are given in order to distinguish the plurality of thin film resistors 102, the plurality of individual ink paths 114 and the plurality of thin film conductive electrodes 104 one by one.

The partitioning wall layer 112 has the partitioning walls 112*a* and 112*b* extending toward the common ink path 115 so that the individual ink paths 114*a* and 114*b* are formed corresponding to the respective thin film resistors 102*a* and 102*b*. The adjacent individual ink paths are partitioned by the partitioning walls 112*a* and 112*b* or the like.

In this case, the thin film resistors 102'*a* and 102'*b* for meniscus vibration are juxtaposed in one row in a one-to-one correspondence in the vicinity of the thin film resistors 102*a* and 102*b* for ink ejection in the respective individual ink paths 114*a* and 114*b* partitioned by the partitioning walls. One side ends of the thin film resistors 102'*a* and 102'*b* are connected to the thin film conductive electrodes 104'*a* and 104'*b* connected to the drive portion 110 and the other side ends are connected to the common electrode 106, respectively. Thus, since the thin film resistors 102*a* and 102*b* for ink ejection and the thin film resistors 102'*a* and 102'*b* for meniscus vibration are juxtaposed in one row, the thin film conductive electrodes 104*a*, 104'*a*, 104*b* and 104'*b* may be set to have a large lateral width which enables reduction of the wiring resistance by the electrodes.

Note that the thin film resistor 102'*a*, the thin film conductive electrode 104'*a* and the common electrode 106 form a second drive element provided in the vicinity of the first drive element according to the present invention.

The phrase "form the second drive element in the vicinity of the first drive element" as used herein means that the second drive element is provided in a position in which the ink in the ink jet nozzle corresponding to the first drive element can be vibrated to change the meniscus position.

The thin film resistors 102'*a* and 102'*b* are heated by the drive signals from the drive portion 110 to generate bubbles in the ink boiled by heating. Since the ink jet nozzle is not provided upwardly unlike the thin film resistors 102*a* and 102*b*, the meniscus position of the ink within the ink jet nozzles 116*a* and 116*b* positioned in the respective individual ink paths 114*a* and 114*b* is fluctuated by the pressure fluctuation of the ink by the expansion and elimination of the bubbles generated.

Figure 4:
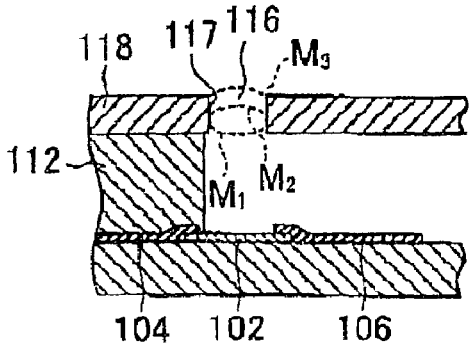
FIG. 4 is a view illustrating meniscus vibration of the ink jet head according to the present invention.

Thus, the meniscus position of the ink within the corresponding ink jet nozzles 116*a* and 116*b* is fluctuated by the expansion force of the bubbles generated by the heat generation of the thin film resistors 102'*a* and 102'*b*. The thin film resistors 102*a* and 102*b* can be heated to eject the ink droplets with the timing with which the meniscus position is at the opening end as in the meniscus position $M_3$ as shown in FIG. 4, with the timing with which the meniscus position is lowermost as in the meniscus position $M_1$ as shown in FIG. 4 or with the timing with which the meniscus position is between the meniscus positions $M_1$ and $M_3$ as in the meniscus position $M_2$ as shown in FIG. 4. As described above, since the ink within the ink jet nozzle 116 is all ejected as the ink droplet, if the ink is ejected when the meniscus position is in the vicinity of the opening end of the ink jet nozzle 116, the ink forms the largest ink droplet. If the ink is ejected when the meniscus position is lowest within the ink jet nozzle 116, the ink forms the smallest ink droplet. Also, if the ink is ejected when the meniscus position is in the intermediate position, the ink forms an intermediate size ink droplet.

In order to prevent the cavitation fracture that is likely to occur when the bubbles generated by the thin film resistors 102'*a* and 102'*b* are eliminated, in order to protect the thin film resistors 102'*a* and 102'*b*, the auto-oxidized coating obtained by auto-oxidation of the surface of the thin film resistors 102'*a* and 102'*b* or the protective film formed of SiO2 or Ta2O5 or the like is formed on the surface of the thin film resistors 102'*a* and 102'*b* which is to be brought into contact with the ink. In particular, in the case where the thin film resistors 102'*a* and 102'*b* are made of Ta—Si—O three-element alloy, it is possible to form the auto-oxidized coating that is excellent in electric insulation and also anti-cavitation property and in addition the auto-oxidized coating may have a very small thickness of 0.01 μm. Accordingly, in view of the increase of the responsiveness of the bubble generation to the voltage applied and the small voltage applied, it is preferable to form the auto-oxidized coating.

On the other hand, as shown in FIG. 4, the surface of the plate 118 and also the inner surface of the ink jet nozzle 116 are subjected to the water-repellent process such that the inner surface of the ink jet nozzle 116 has on the side of the thin film resistor 102 a hydrophilic property which changes gradually or stepwise to water-repellent property toward the opening end side of the ink jet nozzle 116. In this case, the hydrophilic property means the case where the contact angle of the ink is 90 degrees or less, the water-repellent property means the case where the contact angle of the ink exceeds 90 degrees.

In this water-repellent process, in the case where the plate 118 is made of polyimide film, the plasma etching process with oxygen gas is applied to the film surface to form regularities having a height of 30 to 60 nm thereby performing the repellent process of the film surface. At the same time, for the inner surface 116*a* of the ink jet nozzle 116, for example, fluorinated surface active agent ($C_8F_{17}CH_2CH_2SiCl_3$) is dissolved in cyclohexane solution and this solution is printed on the surface of the plate 118 at a uniform thickness by a flexography printing method, thereby chemically adsorbing the repellent monomer film onto the inner surface of the ink jet nozzle 116. Then, this printing is repeated by changing the concentration of the fluorinated surface active agent and the thickness or the print by the flexography so that the hydrophilic property is changed to the water-repellent property gradually or stepwise toward the opening end of the ink jet nozzle 116. Thus, the repellent process may be applied to the inner surface of the ink jet nozzle 116.

The water-repellent process for changing gradually or stepwise the inner surface of the ink jet nozzle 116 from the hydrophilic property to the water-repellent property may be performed by spraying the cyclohexane solution or the like having the fluorinated surface active agent dissolved therein into the bored ink jet nozzle 116 by changing the spray angles.

Thus, since the inner surface 117 of the ink jet nozzle 116 is changed gradually or stepwise from the hydrophilic property to the water-repellent property from the lower side to the upper side in FIG. 4, even if the fluctuation in pressure of the ink for exciting the meniscus vibration is small, it is possible to fluctuate largely the meniscus position of the ink within the inner surfaces 117 and 116*a* of the ink jet nozzle 116 like the meniscus positions $M_1$ to $M_3$.

On the other hand, in the case where the inner surface 117 of the ink jet nozzle 116 has the hydrophilic property without any repellent process, the meniscus position is likely to be fixed and maintained in the vicinity of a border with the surface of the plate 118 having the water-repellent property, i.e., the opening end of the ink jet nozzle 116. In order to move largely the meniscus position within the ink jet nozzle 116, it is necessary to provide the high pressure of the ink. For this reason, in order to largely fluctuate the meniscus position, it is necessary to enlarge the bubble generated by the above-described thin film resistors 102'*a* and 102'*b* or to enlarge the size of the above-described thin film resistors 102'*a* and 102'*b*. As a result, there is a disadvantage in view of the efficiency of the applied energy in that the applied voltage has to be elevated. Also, in the case where the hydrophilic property and water-repellent property are abruptly changed stepwise, there is a disadvantage that in order to largely fluctuate the meniscus position, the voltage applied to the above-described thin film resistor 102' and 102'*b* has to be increased or the size of the thin film resistors 102'*a* and 102'*b* has to be enlarged.

In view of the above, the inner surface 117 of the ink jet nozzle 116 is changed from the hydrophilic property to the water-repellent property gradually or stepwise so that, even if the pressure of the ink exciting the meniscus vibration is small, the meniscus position of the ink may be moved largely and the size (ejection amount) of the ink droplet may be changed largely.

In the ink jet head 52 described above, as shown in FIG. 5A, the drive signal $V_m$ for meniscus vibration is supplied from the drive signal control circuit 110*a* within the control portion 110 to the thin resistor 102' to thereby generate the bubble $B_m$ for meniscus vibration. In the case where the thin film resistor 102' is formed of Ta—SiO three-element alloy protected by the auto-oxidized coating, the bubble $B_m$ is subjected to a predetermined applied energy at a heating rate at which the heating of the ink exceeds $1\times10^{8\circ}$ C./sec to $5\times10^{8\circ}$ C./sec up to about 315° C., the growth of the generated bubble locally occurs in the vertical direction to the surface of the thin film resistor and in addition, a so-called swinging nuclear boiling which is characterized by the abrupt expansion of the bubble. Such swinging nuclear boiling in utilized so that the maximum growth of the bubble may be obtained in the very early stage for about 3 μsec from the application start of the drive signal $V_m$ and thereafter the bubble is eliminated.

Figure 5A:
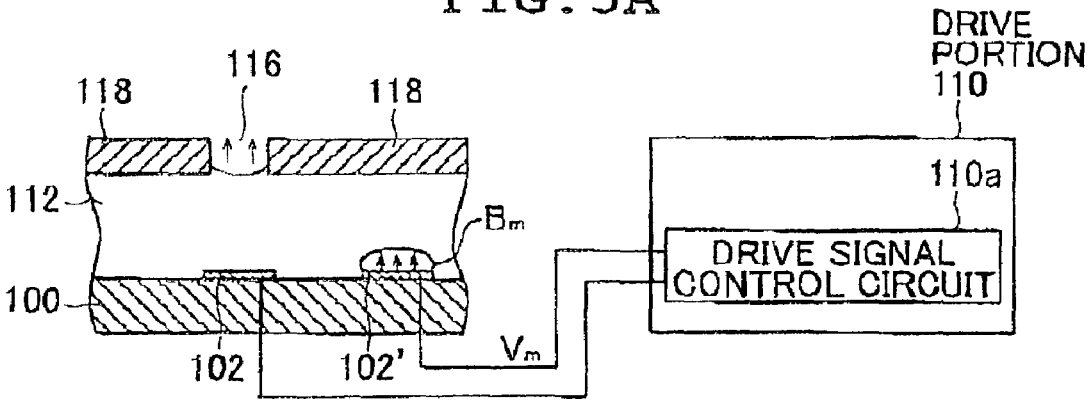
FIGS. 5A and 5B are views illustrating ink ejection performed in conformity with the meniscus vibration in an embodiment of the ink jet head according to the present invention, respectively.
Figure 5B:
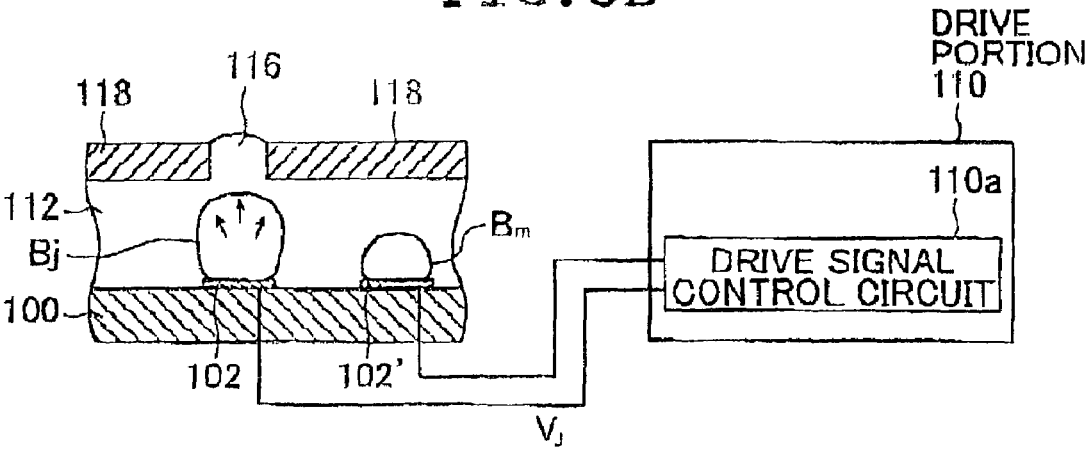
Figure 6A:
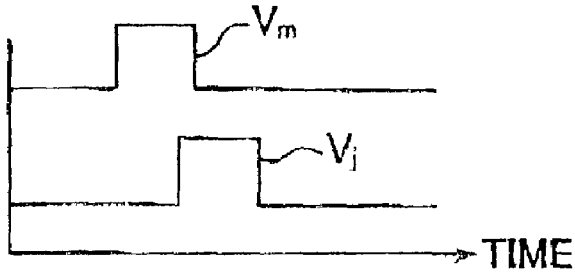
FIGS. 6A and 6B are each a time chart illustrating drive signal for ink ejection performed in conformity with the meniscus vibration in an embodiment of the ink jet head according to the present invention.

The drive signal $V_j$ is applied to the thin film resistor 102 to thereby generate the bubble $B_j$ for ejecting the ink with a suitable timing so that the ink droplet is ejected at the position where the ink has a maximum meniscus position within the ink jet nozzle 116 in accordance with the maximum growth of the above-described bubble $B_m$ as shown in FIG. 5B. Thus, the large ink droplet is ejected. In the drive signal control circuit 110*a*, as an example, as shown in FIG. 6A, the drive signal is produced so that the drive signals $V_m$ and $V_j$ are partially overlapped each other.

Figure 6B:
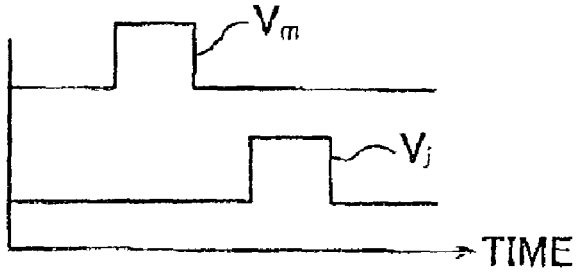

On the other hand, the drive signal $V_j$ is applied to the thin film resistor 102 to generate the bubble $B_j$ for ejecting the ink with a suitable timing so that the ink droplet is ejected in the position where the shrinkage of the above-described bubble $B_m$ starts and the meniscus position of the ink is at the lowest position within the ink jet nozzle 116. In the drive signal control circuit 110*a*, as an example, as shown in FIG. 6B, the drive signals $V_m$ and $V_j$ are produced. This is also the case when the intermediate size ink droplet is to be ejected.

In this way, the ink droplet is ejected in the desired meniscus position in conformity with the timing of the meniscus vibration of the ink within the ink jet nozzle 116 generated by the expansion or the shrinkage of the bubble $B_m$ generated by the heat of the thin film resistor 102' so that the size of the ink droplet may be adjusted. Accordingly, the size of the ink droplet miniaturized and ejected from each ink jet nozzle in accordance with the high density of the ink jet head may be accurately adjusted. For example, it is possible to adjust the error in ink droplet generated due to the fine dimensional error of the size of the ink jet nozzle and to eject the ink droplet having the uniform size.

In particular, in a so-called top shooter system in which the ink droplet is ejected substantially in the vertical direction to the substrate on which the thin film resistors or the thin film electrodes are formed, as described above, since the thin film resistors or the thin film electrodes may readily be formed with high integration by the semiconductor manufacturing technology, the above-described method for ejecting the ink droplet with a desired timing in conformity with the meniscus vibration can be used to readily make uniform and constant the size of the ink droplet miniaturized in accordance with the high density of the ink jet nozzle.

The above-described embodiment controls the timing with which ink droplets are ejected in conformity with the meniscus vibration in the ink jet nozzle. However, this is not the sole case of the present invention but the meniscus vibration may be controlled in conformity with the timing with which ink droplets are ejected or both may be controlled at a time. In other words, in the present invention, at least one of the timing with which the drive signal for driving the thin film resistor used as the drive element for ink ejection is given and the timing with which the drive signal for driving the thin film resistor used as the drive element for meniscus vibration is preferably controlled by means of the drive signal drive circuit.

The present invention is also not limited to the type in which at least one of the timing with which the drive element for ink ejection is driven and the timing with which the drive element for meniscus vibration is driven is controlled. In addition to or independent of the drive timing, at least one of the strength and width of each of the drive signals of the drive element for ink ejection and the drive element for meniscus vibration may be controlled.

Figure 7A:
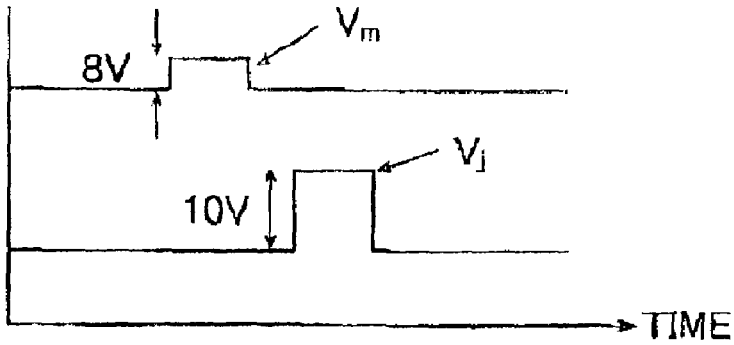
FIGS. 7A and 7B are time charts for ink ejection performed by changing the strength of drive signals given to a thin film resistor for ink ejection and a thin film resistor for meniscus vibration in the ink jet head according to the present invention, respectively.
Figure 7B:
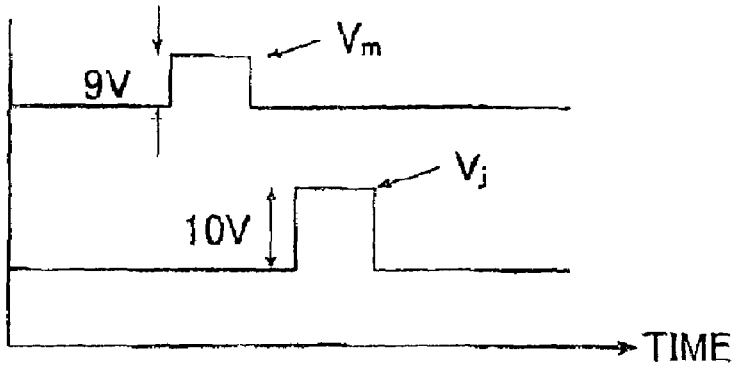

For example, as shown in FIGS. 7A and 7B in the embodiment shown in FIGS. 5A and 5B, the ink meniscus position in the ink jet nozzle 116 during ink ejection can be changed through the drive signal control circuit 110*a* (see FIG. 5A) by changing the signal strength of the drive signal $V_m$ given to the thin film resistor 102' for meniscus vibration from 8V to 9V with respect to the signal strength (pulse strength) of the drive signal (pulse) $V_j$ given to the thin film resistor 102 for ink ejection (i.e., 10V), whereby the size of ink droplets to be ejected from the ink jet nozzle 116 can be changed. It should be noted here that the drive signals $V_m$ and $V_j$ each have a signal width (pulse width) of 1 μsec and that the drive signal $V_j$ rises with a timing 1.6 μsec delayed from the rise of the drive signal $V_m$.

Figure 8A:
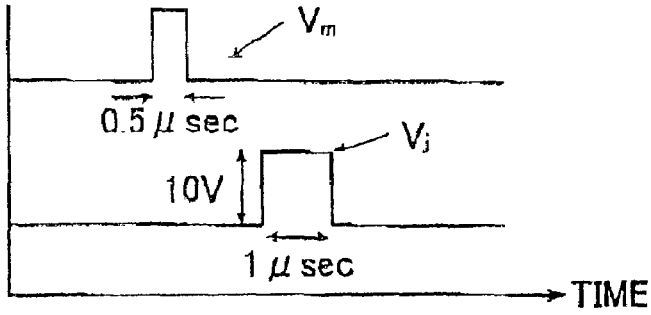
FIGS. 8A and 8B are time charts for ink ejection performed by changing the width of drive signals given to the thin film resistor for ink ejection and the thin film resistor for meniscus vibration in the ink jet head according to the present invention, respectively.
Figure 8B:
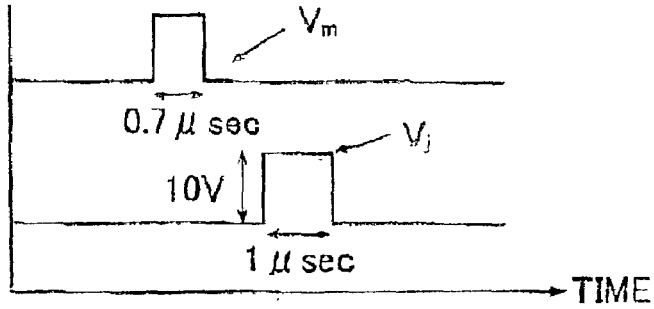

As shown in FIGS. 8A and 8B, for example, the drive signal control circuit 110*a* (not shown; see FIG. 5A) can be used to change the pulse width of the drive signal $V_m$ given to the thin film resistor 102' for meniscus vibration, for example, from 0.5 μsec to 0.7 μsec with respect to the width (pulse width) of the drive signal $V_j$ given to the thin film resistor 102 for ink ejection (i.e., 1 μsec), thereby changing the ink meniscus position in the ink jet nozzle 116 during ink ejection thus changing the size of ink droplets to be ejected from the ink jet nozzle 116. It should be noted here that in the illustrated case, the drive signals $V_m$ and $V_j$ have each a signal strength of 10V and that the drive signal $V_j$ rises with a timing 1.6 μsec delayed from the rise of the drive signal $V_m$.

Figure 9A:
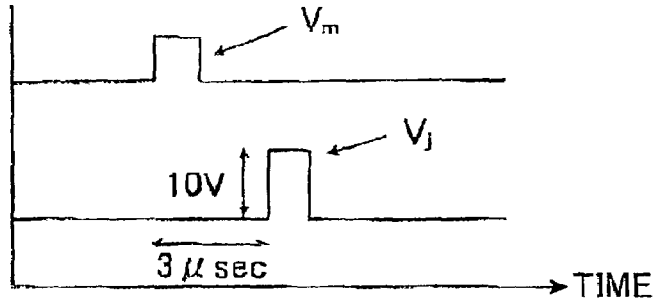
FIGS. 9A and 9B are time charts for ink ejection performed by changing the timing of drive signals given to the thin film resistor for ink ejection and the thin film resistor for meniscus vibration in the ink jet head according to the present invention, respectively.
Figure 9B:
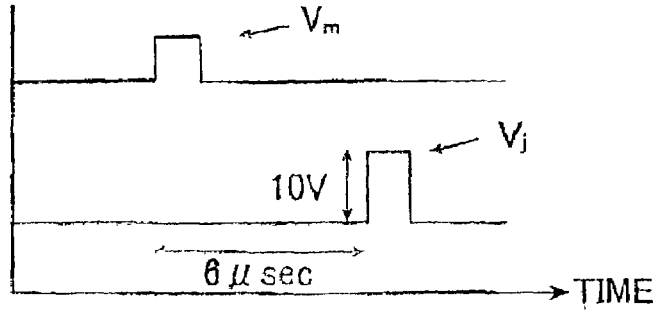

As also shown in FIGS. 9A and 9B, the drive signal control circuit 110*a* (not shown; see FIG. 5A) can be used to change the distance between the rise timing of the drive signal $V_m$ given to the thin film resistor 102' for meniscus vibration and the rise timing of the drive signal $V_j$ given to the thin film resistor 102 for ink ejection, for example, from 3 μsec to 6 μsec, thereby changing the meniscus position during ink ejection thus changing the size of ink droplets to be ejected from the ink jet nozzle 116, which is a matter of course as described above. It should be noted here that the drive signals $V_m$ and $V_j$ in the illustrated case have each a signal strength of 10V and a pulse width of 1 μsec.

As is seen from the above, in the present invention, the drive signal control circuit need only control at least one of the timing with which the drive signal of the drive element for ink ejection is given, the timing with which the drive signal of the drive element for meniscus vibration is given, and the signal strength and signal width that each of the drive signals has.

In the above-described embodiment, the thin film resistor is used as the drive element for exciting the meniscus vibration. However, according to the present invention, it is possible to impart the pressure variation to the ink by changing the volume of the individual ink path by using the piezoelectric type drive element that is the electromechanical converter element instead of the thin film resistor 102. Also, it is possible to use the electrostatic attraction type drive element for exciting the diaphragm and giving the pressure variation to the ink by using the electrostatic attraction.

Figure 10:
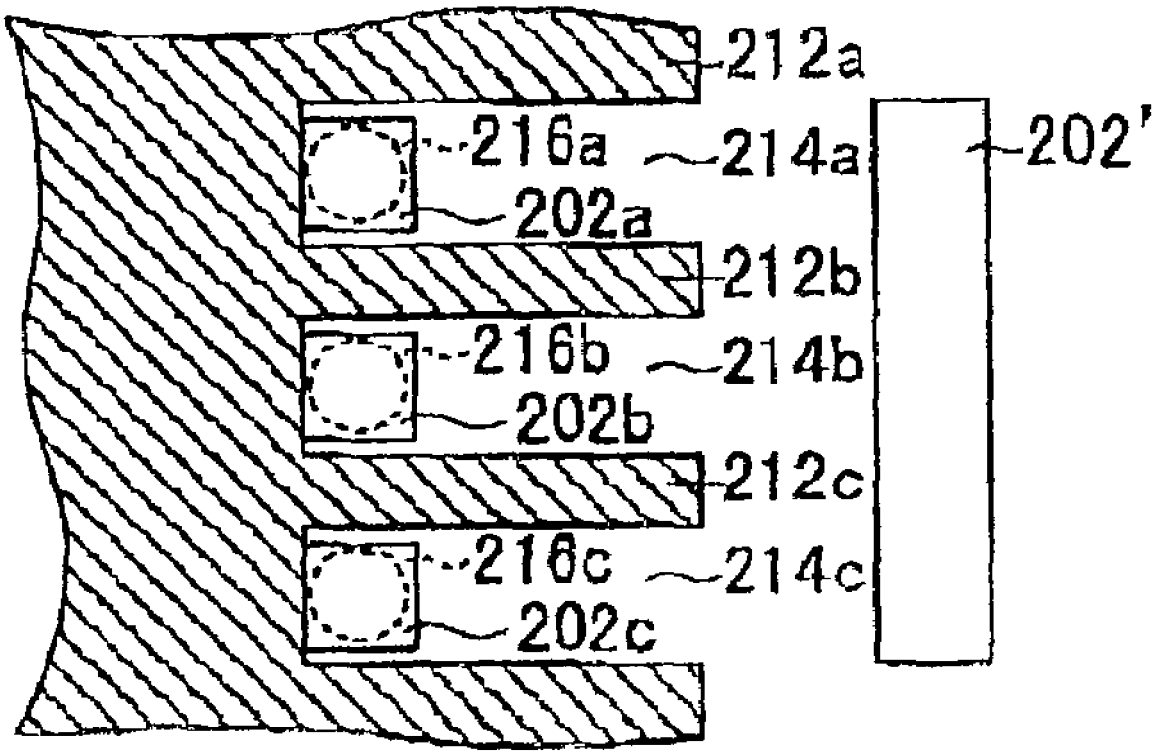
FIG. 10 is a schematic cross-sectional view showing another embodiment of the ink jet head according to the present invention.

Also, as shown in FIG. 10, the thin film resistors 202*a* to 202*c* corresponding to the ink jet nozzles 216*a* to 216*c* may be provided in the respective individual ink paths 214*a* to 214*c* in one-to-one relation, and the drive element 202' for meniscus vibration that is common for the thin film resistors 202*a* to 202*c* may be provided on the front side of the openings of the individual ink paths 214*a* to 214*c*. In this case, the drive element 202' is preferably an electrostatic attraction type drive element or a piezoelectric type drive element.

The thin film resistor for ink ejection, the thin film resistor for meniscus vibration and the partitioning walls may also be used in various types of layouts and forms as shown FIGS. 11A to 11F.

Figure 11A:
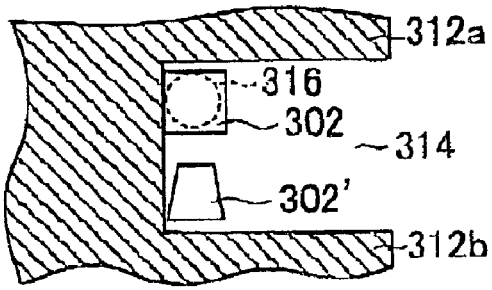
FIGS. 11A to 11F are schematic cross-sectional views showing other embodiment of the ink jet head according to the present invention, respectively.

For example, as shown in FIG. 11A, the thin film resistor 302 for ink ejection corresponding to the ink jet nozzle 316 and the thin film resistor 302' for meniscus vibration are provided within the individual ink path 314 surrounded by the partitioning walls 312*a* and 312*b*, and the lateral width of the thin film resistor 302' in a direction perpendicular to a direction in which the thin film resistor 302' gets closer to the thin film resistor 302, may be continuously reduced in a direction in which the resistor 302' gets closer to the resistor 302. FIG. 11A shows a trapezoidal shape for the resistor. With such a shape, in the case where the voltage is applied to the thin film resistor 302', the bubble is generated from the side having a narrow lateral width and the bubble is gradually grown toward the side having a wider lateral width. Then, the bubble generated by the thin film resistor 302' is expanded in a direction away from the thin film resistor 302. Accordingly, even if the timings of both the drive signals are close to each other to generate bubbles in both the resistors, as in the case where the drive signal for ink ejection partially overlaps the drive signal for meniscus vibration in a temporal manner (see FIG. 6A), there is no fear that the bubble generated by the thin film resistor 302 for ink ejection is brought into contact with the bubble that has been already generated by the thin film resistor 302' to interfere with each other in the expansion and the shrinkage of the bubbles. Accordingly, in the case where the thin film resistor 302' has a shape shown in FIG. 11A, it is possible to make the thin film resistor 302 close to the thin film resistor 302' in comparison with the shape shown in FIG. 3.

Figure 11B:
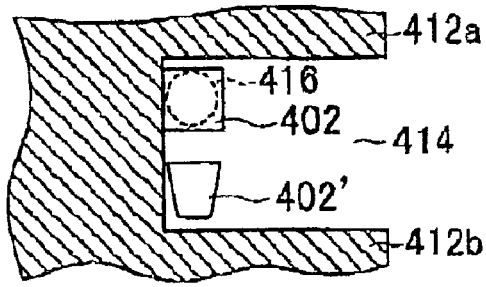

On the other hand, as shown in FIG. 11B, the thin film resistor 402 for ink ejection corresponding to the ink jet nozzle 416 and the thin film resistor 402' for meniscus vibration are provided within the individual ink path 414 surrounded by the partitioning walls 412*a* and 412*b*, and the lateral width of the thin film resistor 402' in a direction perpendicular to a direction in which the thin film resistor 402' gets closer to the thin film resistor 402, may be continuously increased in a direction in which the resistor 402' gets close to the resistor 402. FIG. 11B shows a trapezoidal shape for the resistor. With such a shape, in the case where the voltage is applied to the thin film resistor 402', the bubble is generated from the side having a narrow lateral width and the bubble is gradually grown toward the side having a wider lateral width. Then, the generated bubble is expanded in the direction toward the thin film resistor 402. Accordingly, even if the thin film resistors 402 and 402' are separated from each other to such an extent that the bubbles generated are not brought into contact with each other, the pressure variation of the ink excited by the expansion of the bubble generated by the thin film resistor 402' may be transferred effectively to the ink within the ink jet nozzle 416 whereupon the meniscus position can be largely moved.

It is preferable to select the layout of the thin film resistor shown in FIG. 11A or 11B in view of the distance from the thin film resistor for meniscus vibration to the ink jet nozzle, the presence/absence of the contact of the bubbles generated or the like.

Furthermore, the lateral width of the thin film resistor for meniscus vibration in the direction perpendicular to the direction in which the thin film resistor for meniscus vibration gets closer to the thin film resistor for ink ejection, may be increased or decreased stepwise in the direction in which the resistor for meniscus vibration gets closer to the resistor for ink ejection.

Figure 11C:
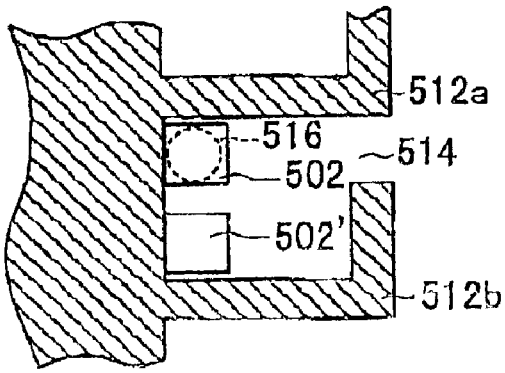
Figure 11D:
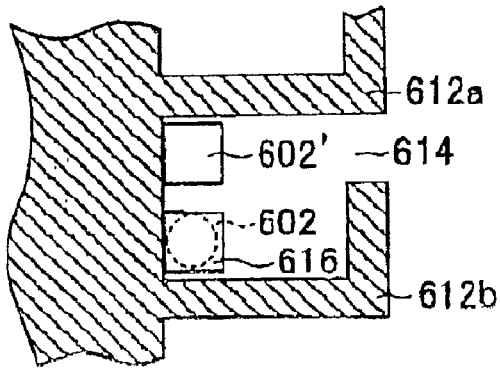

FIGS. 11C and 11D show arrangements of the thin film resistors within the individual ink path 514 and the individual ink path 614 surrounded by partitioning walls 512*a* and 512*b* and the partitioning walls 612*a* and 612*b* whose intermediate portion is bent. In this case, since the individual ink path 514 and the individual ink path 614 are surrounded by the partitioning walls 512*a* and 512*b* and the partitioning walls 612*a* and 612*b*, the pressure variation in ink generated by the expansion of the bubble generated by the thin film resistor for meniscus vibration may be transmitted effectively to the ink within the ink jet nozzle 516 and the ink jet nozzle 616 whereupon effective meniscus vibration can be performed for changing the meniscus position.

In particular, in case of the arrangement of the thin film resistor shown in FIG. 11C, the thin film resistor 516 for ejecting the ink is provided on the side of the opening portion of the individual ink path 514 and the thin film resistor 502' for meniscus vibration is provided on the deep side of the individual ink path 514. Accordingly, the ink is effectively refilled from the opening portion of the individual ink path 514 toward the thin film resistor 516 for ink ejection by the reduced pressure during the shrinkage of the bubble generated by the thin film resistor 502 for meniscus vibration.

On the other hand, in the arrangement of the thin film resistor shown in FIG. 11D, the thin film resistor 616 for ejecting the ink is provided on the deep side of the individual ink path 614 surrounded by the partitioning wall 612*b*. Accordingly, the variation in pressure of the ink by the bubble generated in the thin film resistor 602' for meniscus vibration may be effectively transmitted to the ink within the ink jet nozzle 616.

Figure 11E:
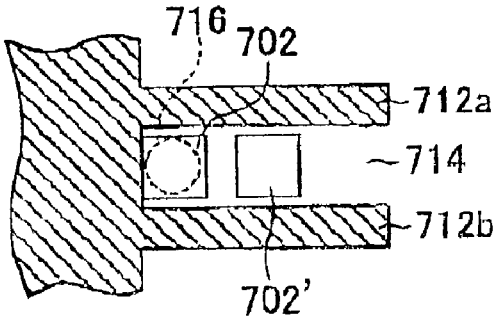
Figure 11F:
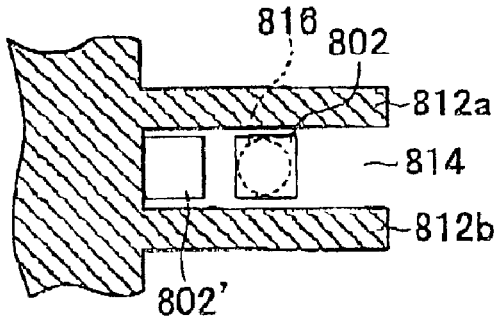

FIG. 11E or FIG. 11F shows the arrangement of the thin film resistor within the individual ink path 714 or the individual ink path 814 surrounded by the partitioning walls 712*a* and 712*b* or the partitioning walls 812*a* and 812*b* extending in one direction.

The arrangement shown in FIG. 11E or FIG. 11F is the arrangement showing that the thin film resistor 702' or the thin film resistor 802' for meniscus vibration is provided on the side of the opening or the individual ink path 714 or the individual ink path 814 or on the deep side in the same manner as in FIG. 11C or 11D. The effect of each arrangement is substantially the same as the arrangement of the thin film resistor shown in FIG. 11C or FIG. 11D.

Incidentally, in all of the above-described embodiments, the thin film resistor for ink ejection and the thin film resistor for meniscus vibration each have substantially the same size. However, according to the present invention, these resistors need not have substantially the same size. The thin film resistor for meniscus vibration need only have such a size that a sufficient ink pressure to fluctuate the meniscus position can be excited.

In each of the embodiments described above, the thin film resistor for ink ejection is provided in the vicinity of the thin film resistor for meniscus vibration on the same substrate. This is not however the sole case of the present invention. The thin film resistor for meniscus vibration may be formed in other components than the substrate on which the thin film resistor for ink ejection is formed.

Figure 12A:
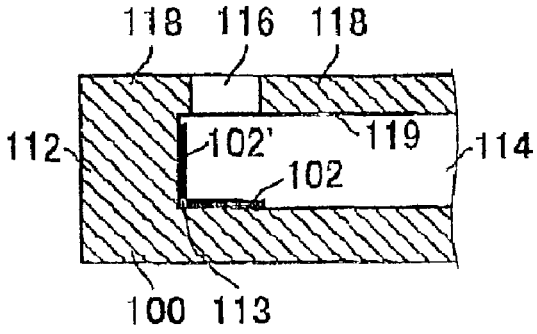
FIG. 12A is a cross-sectional side view schematically showing another embodiment of the ink jet head of the present invention.
Figure 12B:
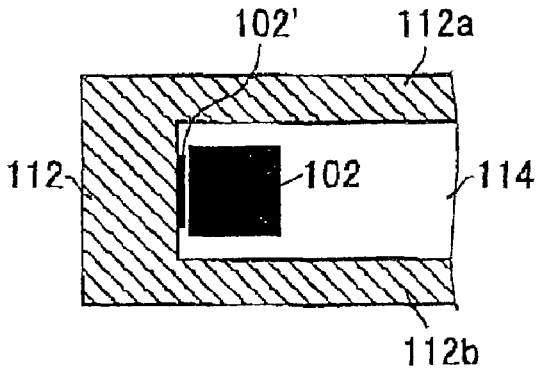
FIG. 12B is a cross-sectional front view of the ink jet head shown in FIG. 12A.

To be more specific, as shown in FIGS. 12A and 12B, the thin film resistor 102' for meniscus vibration may be formed on a front wall surface 113 of the partitioning wall layer 112 formed on the substrate 100 with respect to the thin film resistor 102 for ink ejection formed on the substrate 100 just under the ink jet nozzle 116 perforated through the orifice plate 118, which is unlike the embodiment shown in FIGS. 4, 5A and 5B. The front wall surface 113 of the partitioning wall layer 112, the partitioning walls 112*a* and 112*b*, and the lower surface (ceiling surface) 119 of the plate 118 form the individual ink path 114.

Figure 13A:
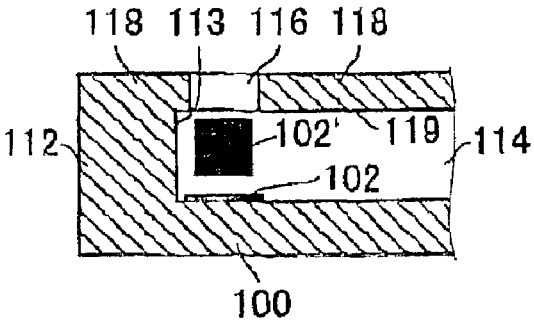
FIG. 13A is a cross-sectional side view schematically showing still another embodiment of the ink jet head of the present invention.
Figure 13B:
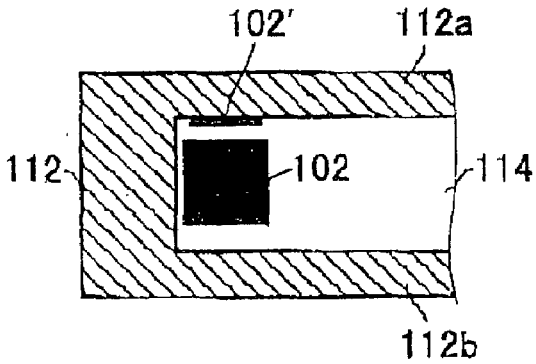
FIG. 13B is a cross-sectional front view of the ink jet head shown in FIG. 13A.
Figure 14A:
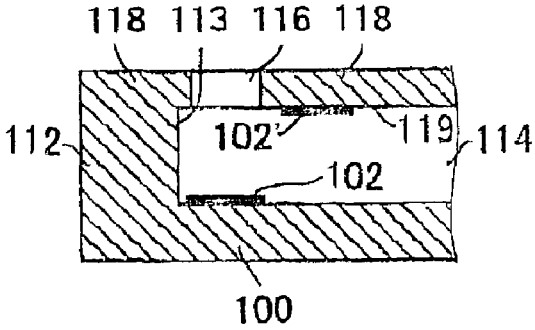
FIG. 14A is a cross-sectional side view schematically showing yet still another embodiment of the ink jet head of the present invention.
Figure 14B:
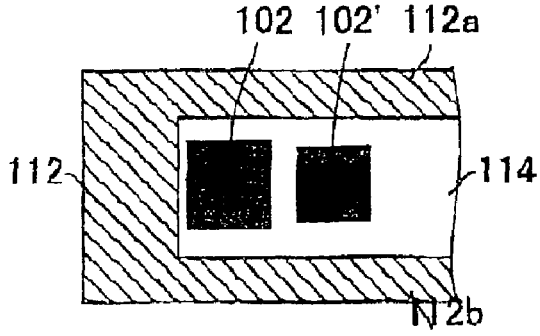
FIG. 14B is a cross-sectional front view of the ink jet head shown in FIG. 14A.

As shown in FIGS. 13A and 13B, the thin film resistor 102' for meniscus vibration may also be formed, for example, on the lateral surface of the partitioning wall 112*a* of the partitioning wall layer 112 with respect to the thin film resistor 102 for ink ejection formed on the substrate 100. Alternatively, as shown in FIGS. 14A and 14B, the thin film resistor 102' for meniscus vibration may be formed on the lower surface (ceiling surface) 119 of the plate 118. In both cases, it is needless to say that the thin film resistor 102' for meniscus vibration is formed in the vicinity of the thin film resistor 102 for ink ejection.

FIGS. 12A, 13A and 14A show cross-sectional side views each corresponding only to one ink jet nozzle 116, whereas FIGS. 12B, 13B and 14B show cross-sectional views when the substrate 100 is seen from the side of the lower surface (ceiling surface) 119 of the plate 118 shown in FIGS. 12A, 13A and 14A, respectively.

As described above, in the case where the thin film resistor is used as the drive element for meniscus vibration in addition to the thin film resistor for ink ejection, the temperature of the ink is elevated as a whole by the heating of the thin film resistor for meniscus vibration, resulting in degradation in viscosity of the ink. For this reason, the refill of the ink may be performed for a short period of time. Also, since the negative pressure is generated together with the shrinkage of the bubbles, the ink around the bubbles, in particular, the additional ink through the individual ink path is likely to flow in the nozzle and the refill of the ink is more quickly achieved.

The layout of the thin film resistor for ink ejection and the thin film resistor for meniscus vibration and the form of the partitioning walls in the embodiments described above are not limited only to the case where a thin film resistor is used for the drive element for meniscus vibration but are also applicable to the case where a piezoelectric type drive element or an electrostatic attraction type drive element is used for the drive element for meniscus vibration.

The embodiments as described above have a new drive element for meniscus vibration in addition to the thin film thermal resistor used as the drive element for ink ejection, but this is not the sole case of the present invention. The thin film resistor acting as the drive element for ink ejection in another ink jet nozzle may be used for the drive element for meniscus vibration as far as this operation enables meniscus vibration in the ink jet nozzle corresponding to the thin film resistor for ink ejection and driving of the thin film resistor for ink ejection in conformity with the meniscus position moving by vibration. In this case, the drive signal must be given to the thin film resistor for ink ejection used as the drive element for meniscus vibration so as to prevent the corresponding ink jet nozzle from ejecting ink droplets.

In the present invention, in order to control the drive signal given to the thin film thermal resistor used as the drive element for ink ejection and the driven signal given to the thin film element for meniscus vibration by means of the drive control means, in other words, the drive timing between the drive signal given to the drive element for ink ejection and the drive signal given to the drive element for meniscus ejection, and also the signal strength and the signal width, the meniscus position in the ink jet nozzle or ink ejection amount (ink droplet size) with respect to the relation between the drive signals of both the drive elements (also including the drive timing, signal strength and signal width) is previously tabulated as LUTs. The drive control means need only use the previously prepared tables to determine the drive signals to be given to both the drive elements from the required ink ejection amount (ink droplet size) or meniscus position in the ink jet nozzle.

Each of the foregoing embodiments refers to a top shooter type thermal ink jet head in which ink droplets are ejected substantially in the vertical direction to the substrate surface. However, the present invention is not limited in any particular way but may refer to a so-called side shooter type thermal ink jet head in which ink droplets are elected substantially in parallel with the substrate surface and a printer utilizing this type of ink jet head.

The ink jet head and the ink jet printer according to the present invention have been described above in detail with reference to various embodiments. However, the present invention is not limited to the above-described embodiments but it is possible to make various changes or modifications within the scope without departing the spirit of the present invention.

As described above in detail, since the present invention uses the drive element for meniscus vibration in addition to the thin film resistor for ink ejection, it is possible to adjust the size of ink droplets in conformity with the changing meniscus position. In particular, although it has been difficult to eject ink droplets from an ink jet nozzle at any meniscus position by exciting meniscus vibration with one thin film resistor in a thermal ink jet type utilizing the thin film resistor as the drive element for ink ejection, the present invention can make the drive signal of the thin film resistor for meniscus vibration close to the drive signal of the thin film for ink ejection and make both the drive signals partially overlap each other in a temporal manner, whereby the drive timing can be set as desired.

Therefore, according to the present invention, in a large-scaled thermal ink jet head which facilitates high integration, in particular in a thermal ink jet head of top shooter type, ink droplets that have become smaller because of higher integration can be made uniform in size, whereby a high-quality image can be recorded on a recording medium.

Since ink droplets of any size can be ejected, the present invention can adjust uniformly or substantially uniformly uneven ejection amount due to the unevenness during the manufacture of the ink jet nozzle, partitioning walls, drive elements and the like in a large-scaled thermal ink jet head with high integration, thereby reducing the burden in the semiconductor process of a thermal ink jet head and thus improving the production yield.

What is claimed is:

1. An ink jet head for ejecting ink droplets from ink jet nozzles to a recording medium, comprising:

a first drive element which is provided in correspondence with each of the ink jet nozzles and which has a first thin film resistor for ejecting said ink droplets from each of said ink jet nozzles by expansion of bubbles generated by boiling part of the ink and a thin film conductive electrode for feeding electricity to said first thin film resistor, said first thin film resistor and said thin film conductive electrode being formed on a substrate;

a second drive element which is formed in a vicinity of said first drive element and which has a second thin film resistor spaced laterally from an axis passing through said first thin film resistor and a nozzle opening in said ink jet nozzles that vibrates the ink in a said ink jet nozzle corresponding to said first drive element for changing a meniscus position in said ink jet nozzle, and a thin film conductive electrode for feeding the electricity to said second thin film resistor; and a drive signal control means which controls at least one of a drive signal given to said first drive element and a drive signal given to said second drive element so that said ink droplets can be ejected at a desired meniscus position during vibration of said ink in each of said ink jet nozzles, wherein said drive signal control means provides said drive signal given to said second drive element prior to providing said drive signal given to said first drive element and wherein said drive signal control means controls at least one of a timing between the drive signal given to said first drive element and the drive signal given to said second drive element, and a strength and a width that each of said drive signals has.

2. The ink jet head according to claim 1, wherein each of said ink jet nozzles is formed in a position facing said thin film resistor of a plate provided as an upper layer of a partitioning wall layer formed on a surface of said substrate, and said ink droplets are ejected from each of said ink jet nozzles substantially in a vertical direction to the surface of said substrate in said ink jet head.

3. The ink jet head according to claim 2, wherein an ink flow path which communicates with each of said ink jet nozzles is formed on the surface of said substrate by said partitioning wall layer, the ink flow path has a flow path height of 15 μm or less and each of said ink jet nozzles has a nozzle length of 35 μm or less.

4. The ink jet head according to claim 1, wherein said thin film resistor of said second drive element changes said meniscus position in each of said ink jet nozzles by vibration with bubbles generated by heating part of said ink.

5. The ink jet head according to claim 4, wherein at least said second drive element further includes a protective film for protecting said thin film resistor of said second drive element or an auto-oxidized coating formed by auto-oxidizing a surface of said thin film resistor of said second drive element on a top surface of said thin film resistor of said second drive element that comes in contact with said ink.

6. The ink jet head according to claim 5, wherein said first drive element further includes a protective film for protecting said thin film resistor of said first drive element or an auto-oxidized coating formed by auto-oxidizing a surface of said thin film resistor of said first drive element on a top surface of said thin film resistor of said first drive element that comes in contact with said ink.

7. The ink jet head according to claim 1, wherein said ink jet head has a plurality of ink jet nozzles, a plurality of first drive elements and a plurality of second drive elements, said first drive elements have a one-to-one correspondence with said ink jet nozzles and said second drive elements are formed in a one-to-one correspondence with said first drive elements.

8. The ink jet head according to claim 7, wherein said first and second drive elements are arranged in one row in one direction, respectively.

9. The ink jet head according to claim 1, wherein said ink jet head has at least a plurality of ink jet nozzles and a plurality of first drive elements, and said first drive elements have a one-to-one correspondence with said ink jet nozzles, respectively, and one second drive element is formed with respect to at least two or more of said first drive elements.

10. The ink jet head according to claim 1, wherein said second drive element is formed on the substrate on which said first drive element is formed.

11. The ink jet head according to claim 1, wherein said first drive element of one ink jet nozzle functions as said second drive element of another ink jet nozzle.

12. The ink jet head according to claim 1, wherein an inner surface of each of said ink jet nozzles has hydrophilic property which changes stepwise or continuously to water-repellent property toward an opening end of each of said ink jet nozzles.

13. The ink jet head according to claim 1, wherein said first drive element and said second drive element are provided in an individual ink path.

14. An ink jet head for ejecting ink droplets from ink jet nozzles to a recording medium, comprising:

a first drive element which is provided in correspondence with each of the ink jet nozzles and which has a thin film resistor for ejecting said ink droplets from each of said ink jet nozzles by expansion of bubbles generated by boiling part of the ink and a thin film conductive electrode for feeding electricity to said thin film resistor, said thin film resistor and said thin film conductive electrode being formed on a substrate;

a second drive element which is formed in a vicinity of said first drive element and which has a second thin film resistor that vibrates the ink in a said ink jet nozzle corresponding to said first drive element for changing a meniscus position in said ink jet nozzle and a thin film conductive electrode for feeding the electricity to said second thin film resistor; and a drive signal control means which controls at least one of a drive signal given to said first drive element and a drive signal given to said second drive element so that said ink droplets can be ejected at a desired meniscus position of said ink in each of said ink jet nozzles, wherein said thin film resistor of said second drive element changes said meniscus position in said ink jet nozzle by vibration with bubbles generated by heating part of said ink, and wherein a lateral width of said thin film resistor of said second drive element in a direction perpendicular to a direction in which said second drive element gets closer to said first drive element is increased or decreased stepwise or continuously as said second drive element gets closer to said first drive element.

15. An ink jet printer comprising an ink jet head for ejecting ink droplets from ink jet nozzles to a recording medium, comprising:

a first drive element which is provided in correspondence with each of the ink jet nozzles and which has a thin film resistor for ejecting said ink droplets from each of said ink jet nozzles by expansion of bubbles generated by boiling part of the ink and a thin film conductive electrode for feeding electricity to said thin film resistor, said thin film resistor and said thin film conductive electrode being formed on a substrate;

a second drive element which is formed in a vicinity of said first drive element and which has a second thin film resistor spaced laterally from an axis passing through said first thin film resistor and a nozzle opening in said ink jet nozzles that vibrates the ink in a said ink jet nozzle corresponding to said first drive element for changing a meniscus position in said ink jet nozzle, and a thin film conductive electrode for feeding the electricity to said thin film resistor; and a drive signal control means which controls at least one of a drive signal given to said first drive element and a drive signal given to said second drive element so that said ink droplets can be ejected at a desired meniscus position during vibration of said ink in each of said ink jet nozzles, wherein said drive signal control means provides said drive signal given to said second drive element prior to providing said drive signal given to said first drive element and wherein said drive signal control means controls at least one of a timing between the drive signal given to said first drive element and the drive signal given to said second drive element, and a strength and a width that each of said drive signals has.

* * * * *